US008001809B2

(12) United States Patent
Thompson et al.

(10) Patent No.: US 8,001,809 B2
(45) Date of Patent: Aug. 23, 2011

(54) LIGHTWEIGHT ROBUST THIN FLEXIBLE POLYMER COATED GLOVE

(75) Inventors: Eric Thompson, Clemson, SC (US); Dave Narasimhan, Flemington, NJ (US); Jeffrey C. Moreland, Pendleton, SC (US); Hafsah binti Mohd. Ghazaly, Petaling Jaya (MY)

(73) Assignee: Ansell Healthcare Products LLC, Red Bank, NJ (US)

( * ) Notice: Subject to any disclaimer, the term of this patent is extended or adjusted under 35 U.S.C. 154(b) by 774 days.

(21) Appl. No.: 11/849,566

(22) Filed: Sep. 4, 2007

(65) Prior Publication Data

US 2009/0055992 A1 Mar. 5, 2009

(51) Int. Cl.
*A41D 19/00* (2006.01)

(52) U.S. Cl. ..... 66/174; 2/161.6; 2/167

(58) Field of Classification Search ..... 66/174, 66/202; 2/16, 159, 161.6, 167, 161.8
See application file for complete search history.

(56) References Cited

U.S. PATENT DOCUMENTS

| | | | | |
|---|---|---|---|---|
| 4,283,244 | A | | 8/1981 | Hashmi |
| 4,497,072 | A | | 2/1985 | Watanabe |
| 4,514,460 | A | | 4/1985 | Johnson |
| 4,515,851 | A | | 5/1985 | Johnson |
| 4,555,813 | A | | 12/1985 | Johnson |
| 4,567,612 | A | | 2/1986 | Johnson |
| 4,569,707 | A | | 2/1986 | Johnson |
| 4,589,940 | A | | 5/1986 | Johnson |
| 4,785,479 | A | | 11/1988 | Watanabe |
| 5,070,540 | A | * | 12/1991 | Bettcher et al. ..... 2/2.5 |
| 5,581,812 | A | | 12/1996 | Krocheski |
| 5,689,976 | A | | 11/1997 | Plemmons et al. |
| 6,527,990 | B2 | | 3/2003 | Yamashita et al. |
| 6,823,699 | B1 | | 11/2004 | Vero et al. |
| 6,915,667 | B2 | | 7/2005 | Morita et al. |
| 6,945,080 | B2 | | 9/2005 | Maeda et al. |
| 6,962,064 | B1 | | 11/2005 | Hardee et al. |
| 7,013,680 | B1 | | 3/2006 | Adams |
| 7,207,194 | B2 | | 4/2007 | Miyamoto |
| 7,213,419 | B2 | | 5/2007 | Hardee et al. |
| 7,246,509 | B2 | | 7/2007 | Hardee et al. |
| 2002/0076503 | A1 | | 6/2002 | Borreani et al. |
| 2004/0221364 | A1 | | 11/2004 | Dillard et al. |
| 2006/0235158 | A1 | | 10/2006 | Ota et al. |
| 2007/0022511 | A1 | | 2/2007 | Narasimhan et al. |

OTHER PUBLICATIONS

"PCT International Search Report and Written Opinion for PCT/US08/75166", (Nov. 18, 2008), 9 pp.

* cited by examiner

*Primary Examiner* — Danny Worrell
(74) *Attorney, Agent, or Firm* — Moser Taboada

(57) ABSTRACT

Lightweight robust thin flexible latex gloves having areas of reinforcement at areas of high stretch and/or movement are provided. Gloves comprise a knitted liner having a plurality of stitches made from a first yarn having a denier 221 or less, the knitted liner comprising a plurality of finger components, a thumb component, and a palm component; and at least one reinforcement section located at a base of at least one finger component, at a base of the thumb component, in the palm component, or combinations thereof, and a polymeric latex coating. Reinforcement sections can be formed by plaiting, using yarn of a heavier denier, and/or forming Jacquard or transfer stitches. The liner can be knitted using with 70 to 221 denier nylon 66 multi-filament yarn. Methods of making and using the gloves are also provided.

20 Claims, 4 Drawing Sheets

LIGHTWEIGHT ROBUST THIN FLEXIBLE POLYMER COATED GLOVE

TECHNICAL FIELD

Aspects of the invention relate to a robust lightweight thin flexible latex glove article having a thin knitted liner provided with superior reinforcement characteristics at high stretch locations, thereby limiting the stretch applied to latex layer partially applied over the knitted liner. The knitted liner is partially covered and penetrated by a thin porous or continuous latex layer thereby providing enhanced flexibility and integrity to withstand repeated flexure. The reinforcement of the knitted liner at high stretch regions increases the robustness of the lightweight glove during industrial usage.

BACKGROUND

Gloves are commonly used to protect hands in an industrial or household environment. The gloves, upon wearing, fill with sweat and feel clammy to the user. Advances in glove manufacturing technologies have resulted in partial coating of a fabric knitted liner with an adherent latex layer on the working side so that glove is breathable in the exposed non-latex layer, knitted areas.

Generally, knitted liners are fabricated from relatively thick robust yarns having 319 denier, (a denier defined as number of grams of a 9000 meter yarn) or greater using 15-gauge knitting needles or larger needles. Knitting machines are designed with a needle gauge specified. For example, a 15-gauge V-bed knitting machine has these 15-gauge needles spaced such that there are 15 needles per inch. Similarly, a 10-gauge needle machine has 10-gauge needles spaced such that there are 10 needles per inch. A 15-gauge needle may generally use a 319 denier yarn for knitting. A smaller size yarn such as a 221 denier yarn is typically suited for an 18-gauge needle. Knitted stitches of 319 denier yarn using a 15-gauge needle will be spaced further apart than knitted stitches of 221 denier yarn using an 18-gauge needle. Regardless of the gauge of needles used, a knitted liner with 221 denier yarn is lighter in weight, thinner and more flexible than a knitted liner with 319 denier yarn. Lighter weight knitted liners are needed to produce lightweight gloves.

When 319 denier yarn is knitted with a 15-gauge needle, the liner created is thick. A latex layer that coats such a liner is also correspondingly thick resulting in a glove with a heavy feel that has limited flexibility. When a foamed, porous latex layer is used in order to provide breathability, the resulting thickness of this porous latex layer generally results in an awkward-feeling glove with limited touch sensitivity. For equivalent wear resistance, the foam layer must be thicker than a non-foamed layer. A number of prior art patents address gloves and their forming methods using relatively thick knitted liners and thick coatings of latex layers. A combination of a thick knitted liner and a thick foamed latex layer does not result in a small overall glove thickness and the resulting glove does not provide flexibility and easy mobility of fingers and hand. Moreover, for a glove having a coating, the coating is susceptible to cracking and deterioration at areas of high stretch and movement, such as, the areas at the base of the fingers and thumb and within the palm area.

U.S. Pat. Nos. 4,514,460 and 4,515,851 to Johnson disclose slip-resistant surfaces. U.S. Pat. Nos. 4,555,813 and 4,567,612 to Johnson discloses slip-resistant gloves. U.S. Pat. Nos. 4,569,707 and 4,589,940 to Johnson disclose methods of making foamed slip-resistant surfaces. This porous surface is particularly useful for workers in work environments wherein the gloves are breathable and have moisture-absorbing properties. The surface is a foam surface laminated to a knitted or woven web substrate. The polyurethane, polyvinyl chloride, acrylonitrile; natural rubber, synthetic rubber foam, prior to lamination, may be foamed with varying amounts of air depending upon the degree of abrasion resistance required. The foaming may be by mechanical or chemical means.

U.S. Pat. Nos. 4,497,072 and 4,785,479 to Watanabe disclose porous coated glove and method of making a glove. Broken air bubbles form the porous surface. The air cells are closed and provide cold protection and waterproof qualities. The thick closed cell foam is bonded to woven or knitted sewn fabric. Due to its cold protection properties this is a thick glove with minimal flexibility.

U.S. Pat. No. 5,581,812 to Krocheski discloses a leak proof textile glove. A cotton glove is inverted and dipped in a PVC or polyurethane latex solution to make the cotton glove impervious to water or oil. The glove is inverted so that the cotton surface is the gripping surface while the latex layer contacts the skin. The latex layer may be optionally flocked to provide a better skin feel. There is no knitted liner in this glove. The latex layer applied is impervious to water or oil, but is not breathable.

U.S. Pat. No. 6,527,990 to Yamashita et al. discloses a method for producing a rubber glove. The rubber glove is made by sequential immersion of a glove mold in coagulating synthetic rubber latex that contains thermally expansible microcapsules. During the vulcanization of the synthetic rubber latex, these microcapsules burst providing excellent anti-blocking and grip under wet or dry conditions. There is no knitted liner in this glove and the latex layer completely surrounds the hand.

U.S. Patent Publication No. 2002/0076503 to Borreani discloses a clothing article such as a working or protective glove made from textile support. The textile support receives an adherence primer in the form of an aqueous calcium nitrate. The textile support with the adherence primer is coated with a foamed aqueous polymer, preferably an aliphatic polyether urethane or polyester urethane entirely or partially. The foamed aqueous polymer only appears on the support outer part without going through the textile support mesh. When the textile support is too hydrophilic, 2-5% fluorocarbon is added to the aqueous latex emulsion. The size of the yarn in the textile support is not indicated. The patent does not indicate why the aqueous polymer does not penetrate the textile support mesh. The viscosity of the aqueous air foam is in the range of 1500 to 3000 centipoise and this thick foam may not enter the mesh, but only contacts the fibers at very localized regions creating a poor bond between the polymeric layer and the textile support.

U.S. Patent Publication No. 2004/0221364 to Dillard et al. discloses methods, apparatus, and articles of manufacture for providing a foam glove. A textile shell is coated with a foamed polymeric coating that is supported in part by the surface of the textile shell. Sufficient amount of air mixed with the base polymer to lower the density of the base polymer between about 10 to 50% of the original density of the base polymer. The textile shell is knitted using nylon, polyester, aramid, cotton, wool, rayon or acrylic fibers. The foam cells absorb liquid, which indicates that the foamed polymer does not protect the hand from water or oil present on the object being gripped. The yarn is said to be knitted with a 15-gauge needle using a Shima Seiki knitting machine that fixes the size of the knitted textile shell to be a thick shell, not a thin shell. As a result, the foam glove is a thick product and is not very flexible.

The knitting technology of V-bed machines have improved significantly in the past few years. Knitting needles in the knitting machine were essentially a hook with a swingable latch that captured a yarn that was being knitted, but this knitted loop could not be held or transferred back or combined with a previously knitted loop. U.S. Pat. No. 6,915,667 to Morita, et al. discloses a composite needle of knitting machine. This composite needle comprises a needle body having a hook at a tip end and a slider formed by superposing two blades. The composite needle of the knitting machine is formed such that a blade groove provided in the needle body supports the blades of the slider when the needle body and the slider can separately slide in forward and backward directions. This slider acts as a latch securing the yarn being knitted and can transfer the yarn loop for pushing the loop backwards, holding the loop or transfer back to a previously knitted loop. Complex patterns that can be achieved are detailed by the Shima Seiki web page http://www.shimaseiki.co.jp/product_knite/knite.html. This type of composite needle is available in Shima-Seiki commercially available whole garment knitting machines SWG021/041 and SWG-FIRST machines. The SWG-FIRST machines provides gaugeless knitting, meaning that the number of needles may be changed on the fly under computer control seamlessly by using split stitch technology, as detailed in U.S. Pat. No. 7,207,194 to Miyamoto titled 'Weft knitting machine with movable yarn guide member'.

Knitted liners that are shaped according to the anatomical shape of a human hand for improved fit are disclosed in U.S. Pat. Nos. 6,962,064; 7,213,419; and 7,246,509 to Hardee, et al. These knitted liners are made to fit human hand shape by changing the knitted loop length under computer control, or changing the yarn tension.

U.S. Patent Publication No. 2007/0022511 to Narasimhan et al. discloses selective multiple yarn reinforcement of a knitted glove with controlled stitch stretch capability. The controlled stitch stretch is provided by a variable stitch dimension and is accomplished by 1) varying the depth of penetration of the knitting needle into fabric being knitted by a computer program, 2) adjusting the tension of yarn between a pinch roll and knitting head by a mechanism controlled by a computer and 3) casting off or picking up additional stitches in a course.

Accordingly, there is a need in the art for robust durable thin lightweight highly flexible latex gloves that have the latex layer applied to a lightweight knitted liner at work-contacting portions of the glove surface. There is also a need to provide gloves having reinforcement sections to provide enhanced flexibility and integrity to withstand repeated flexure. It is also desirable to have a latex layer that is porous providing additional breathability and improved flexibility.

SUMMARY

Provided are gloves formed from lightweight yarns having areas of reinforcement at areas of high stretch and/or movement. Methods of making and using the same area also provided.

With regard to comfort of gloves, flexibility of a glove is a strong function of the thickness of the glove and increases according to the inverse of the cube of the thickness. Thus, a reduction of the thickness of an elastic body such as a latex layer coated glove by 30 percent increases the flexibility by a factor of three. The thickness of the glove is made up of the thickness of the knitted liner and the thickness of the adherently bonded polymeric layer. The flexibility may be greater than that expected based on elastic body calculation since the knitted liner is capable of displacing at the knitted yarn level. This factor is even more significant when the individual yarn is made up of a plurality of strands instead of being a monofilament yarn. This enhancement in flexibility may be lost if a stiff polymer completely penetrates the liner; the stiffness of the glove drastically increases due to the stiffening of the knitted layer.

Typically, for coated knitted work gloves, a commonly used knitting needle is a 15-gauge needle. Shima Seiki manufactures knitting machines that are capable of using finer knitting machine needle size, such as an 18-gauge needle. According to Spencer D. J. Knitting Technology, p 209, 1993, the gauge of the knitting machine needle has a definite relationship with the denier of the yarn that can be used. For example, a needle of gauge 15 uses 319 denier yarn. However, a needle of gauge 18 uses 221 denier yarn. Denier is defined as number of grams of a yarn having a length of 9000 meters. Therefore, a liner knitted by an 18-gauge needle is approximately 30% lighter than a liner knitted with a 15-gauge needle. The small diameter of 221 denier yarn knitted with an 18-gauge needle also has higher packing density of knitted stitches per square unit area, thereby presenting a smoother surface for latex dip resulting in a smoother, smaller thickness of latex.

Since the yarn size of an 18-gauge needle yarn is smaller than that of a 15-gauge yarn, the 18-gauge thin knitted liner has smaller spaces between the stitches and/or yarns. Use of this 18-gauge knitting needle generally means that the stitches and/or yarns in the knitted liner are spaced one to three times the yarn diameter. As such, small interstices are provided between the yarns and/or stitches. In order to bond a latex layer to the thin knitted liner the latex should penetrate half way or more through the thickness of the thin knitted liner. A penetration of the latex layer less than half the thickness generally results in poor adhesion, and can result in unexpected separation of the latex layer. However, if the entire latex layer penetrates the knitted liner completely, the polymeric coating is available for contacting the skin of the glove wearer resulting in undesirable effects and sometimes irritation. This problem can be, and has been previously, managed using a 15-gauge needle yarn due to the large thickness of the liner available.

When a glove with the lightweight 221 denier yarn (knitted with an 18-gauge needle) and an adherent latex layer is worn by a worker and is used in an industrial environment requiring movements of thumb and fingers, the portion of the glove at the base of the fingers and the thumb stretches to a large extent by this movement. This large stretch displaces the stitch pattern of the thin knitted liner in these locations and applies high stresses to the thin adherent latex layer in contact with the thin knitted liner. Under severe usage conditions, this movement can result in weakening of portions of the adherent layer into islands which leads to surface wear and deterioration of the latex. Aspects of the present invention combat this problem by selectively reinforcing areas of high stretch and/or movement, such as the areas at the base of the fingers and thumb of the thin knitted liner and within the palm area. In one or more embodiments, stitch spacing in a reinforcement section is smaller than the stitch spacing in the remainder of the glove.

According to one embodiment, knitting technology commonly termed as 'plaiting' is used, that is the introduction of a second yarn in conjunction with a first yarn. In this embodiment, a knitted liner formed from a plurality of stitches made from a lightweight yarn and comprising a plurality of finger components, a thumb component, and a palm component is provided, and a second yarn is brought in the regions of stretch and movement thereby providing more yarn strands per unit stitch length. The second yarn used for plaiting is usually a lighter weight fiber than that used for the knitted liner. When the knitted liner is stretched in these regions, the distance between the yarn strands therein is still small resulting in reduced stress transfer to the adherent thin latex layer immediately in contact with it, thereby preserving the integrity of the thin lightweight glove even under heavy industrial usage. This plaiting can be achieved using a standard V-bed knitting machine since the knitted stitches are continued with a second yarn feed at selected locations of the thin knitted liner.

In another embodiment, a larger denier yarn such as a 319 denier yarn is used to knit these highly stretched regions while the rest of the thin knitted liner is knitted with the 221 denier yarn. Since all the needles in the V-bed knitting machine bed are the same size and spacing, 319 denier yarns are spaced closer to each other than the 221 denier yarns. Thus, application of high stretch to reinforcement sections of 319 denier results in reduced stress application to the adherent latex layer due to the smaller spacing between the yarn as compared to the 221 denier. In addition, due to the larger denier of the yarn in these regions, the latex layer in these regions may also be increased in thickness providing additional robustness. This changeover of the larger denier yarn in these regions can be accomplished using a standard V-bed knitting machine with a bed of 18 gauge needles.

In a further embodiment, a knitting technology called Jacquard stitch, commonly used in the whole-garment knitting industry and also referred to as a transfer stitch, is used in the reinforcement sections of the knitted liner. This allows three or more staged stitches to be formed in a single row creating a thicker fabric, yet using the same 221 denier yarn. This Jacquard stitch technique generally uses a needle arrangement that can transfer a stitch and this can be accomplished by a Shima Seiki SWG021/041 or SWG-FIRST knitting machine. Both machines use a two-part needle having a first part with a hook and a second part that slides over the first part. The slider functions as a conventional latch while transferring the knitted stitch to a transfer arm as needed under computer control. The SWG-FIRST is a gaugeless knitting machine where in the gauge of number of stitches per inch may be varied on the fly under computer control. The Jacquard stitch regions do not stretch as much as a conventionally knitted stitch, such as a Jersey knit, and as a result, the adherent latex in contact with the thin knitted regions in these highly stressed regions is preserved. Since the Jacquard stitch results in a thicker liner in these regions, the latex layer adherent in these areas may also be thicker increasing the robustness of the glove in heavy duty service.

Generally stated, an aspect of the present invention provides a glove with a thin knitted liner with reinforcement sections in areas of high stretch and movement, such as at finger and thumb base regions, and a polymeric latex coating layer. In a specific embodiment, provided is a knitted liner having a plurality of stitches made from a yarn having a denier 221 or less, the knitted liner comprising a plurality of finger components, a thumb component, and a palm component; at least one reinforcement section located at a base of at least one finger component or the thumb component of the knitted liner; and a polymeric latex coating adhered to the knitted liner. The latex coating layer can be approximately 0.75 to 1.25 times the thickness of the knitted layer, and the polymeric latex coating can penetrate half way or more through the thickness, and for at least a portion of the knitted liner. Yarn size is generally 221 denier or less in areas other than in the areas of high stretch and movement.

The 221 denier yarn used can be a partially-oriented nylon 66, with a specification 2-ply/70 denier/103 filament or 2 ends of 1-ply/70 denier/103 filament, each filament having 0.68 denier, typically a filament with a denier that is less than 1 denier per filament. This bundle of multi-filament yarn with a large number of very small denier filaments is very highly flexible and therefore, the knitted liner is also very highly flexible. The 18-gauge needle can take a single yarn of 2 ply of 70 denier yarn or 1 ply yarn of 140 denier yarn or a single yarn as large as 221 denier to knit the liner.

In one or more embodiments, this lightweight thin knitted liner using a 221 denier yarn is reinforced selectively at any portion of the base of any of the finger or thumb components, for example where finger and/or thumb components meet the palm component. Another suitable region for reinforcement is anywhere within the palm component that is subject to stretch and movement by the user, such as where the palm component bends upon movement of the user's knuckles. This reinforcement may in the form of several knitting geometries. A first knitting geometry involves uses of a second plaiting yarn in the reinforcement sections of the knitted liner in addition to the base yarn. In a second knitting geometry, the reinforcement sections are knitted with a yarn that is larger than the 221 denier yarn. In a third knitting geometry, a Jacquard stitch is used to make the reinforcement sections robust.

In one or more embodiments, the polymeric latex layer is only coated over selected portions of the glove generally including the palm and finger regions of the glove while the portion of the liner at the back of the hand are not coated with the polymeric latex layer, thereby promoting breathability. In detailed embodiments, the polymeric latex coating is selected from a group consisting of natural rubber, synthetic polyisoprene, styrene-butadiene, carboxylated or non-carboxylated acrylonitrile-butadiene, polychloroprene, polyacrylic, butyl rubber, or water-based polyurethane (polyester based or polyether based), or combinations thereof. In a specific embodiment, the polymer comprises carboxylated acrylonitrile-butadiene latex formed from an aqueous latex emulsion. In an embodiment, the overall thickness of the glove is in the range of 0.6 mm to 1.14 mm. In a detailed embodiment, the overall thickness is from approximately 0.70 to approximately 0.90 mm.

In an embodiment, the polymeric latex layer is foamed using well dispersed air cells in the range of 5 to 50 volumetric percentage forming closed cells or open cells with interconnected porosity in the polymeric latex layer. Closed cells provide a liquid proof polymeric latex coating that is highly flexible, soft and spongy, and provides good dry and wet grip. Closed cells are normally associated with air content in the 5 to 15 volumetric percent range. Open cells that are interconnected normally occur in the 15-50% air volumetric range and provide breathability of the glove through the foamed polymeric latex layer. The glove with open cell foam exhibits breathability in the sense that one can blow air through the polymeric latex coating of the glove by cupping the mouth, encountering very little resistance. Breathability of the glove is always available through portions of the knitted liner that is not coated with the foamed polymeric latex layer, such as the backside of the glove. This foamed polymeric latex layer also penetrates half or more of the thickness of the knitted liner, and for at least a portion of the knitted liner, the polymeric latex layer does not penetrate the entire thickness, thereby substantially avoiding skin contact of the polymeric latex.

In a further aspect, provided are processes for making a lightweight flexible glove, the processes comprising: creating a glove-shaped liner comprising a plurality of finger components, a thumb component, and a palm component, such that the liner comprises a plurality of stitches made from a first yarn having a denier of approximately 221 or less; creating at least one reinforcement section located at a base of at least one finger component, at a base of the thumb component, in the palm component, or combinations thereof; and providing a polymeric latex coating adhered to the knitted liner.

Other aspects include methods of performing industrial work, the methods comprising wearing a glove, comprising: a knitted liner having a plurality of stitches made from a first yarn having a denier 221 or less, the knitted liner comprising a plurality of finger components, a thumb component, and a palm component; at least one reinforcement section located at a base of at least one finger component, at a base of the thumb component, in the palm component, or combinations thereof, and a polymeric latex coating adhered to the knitted liner.

DETAILED DESCRIPTION

Figure 1:
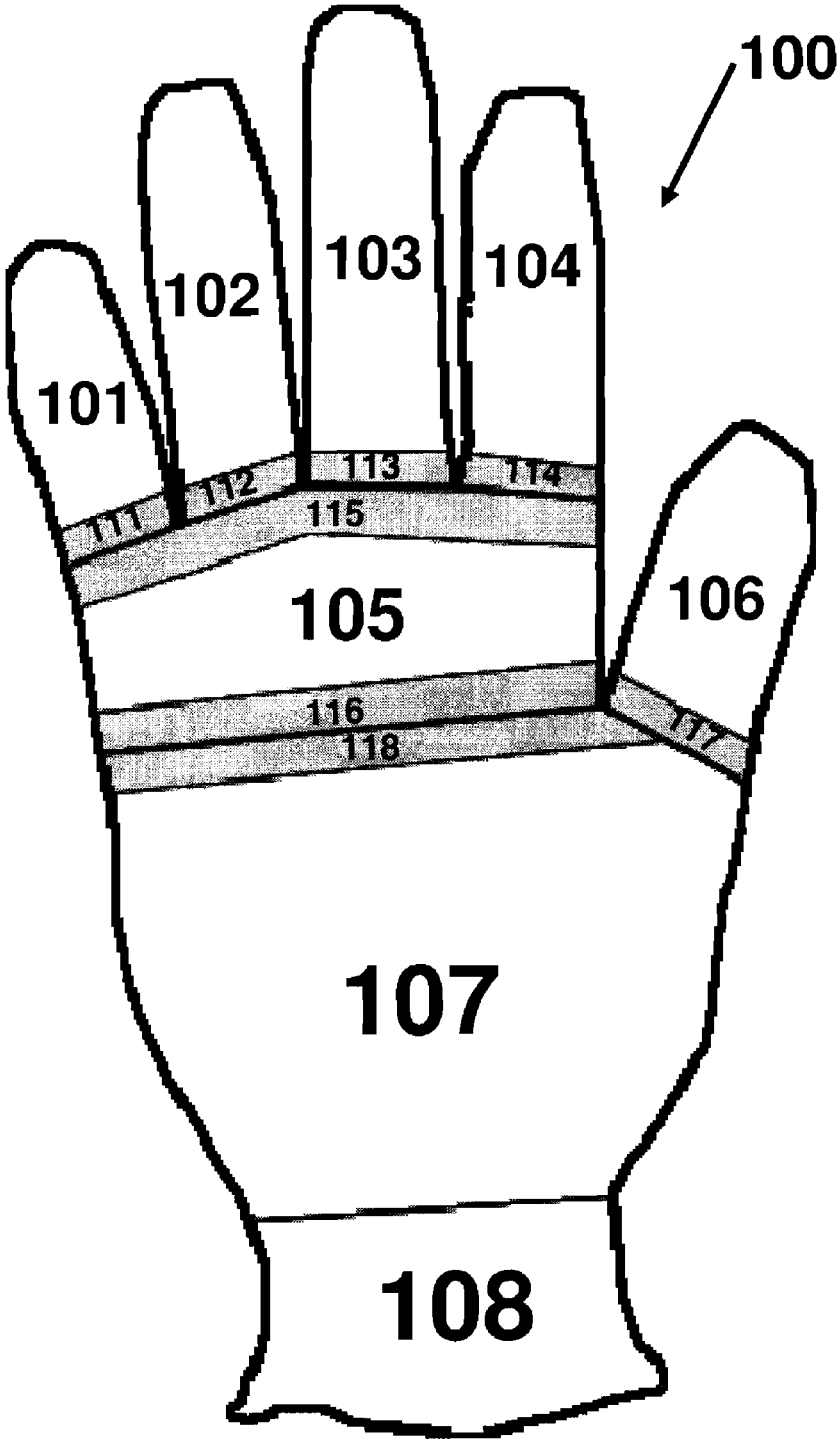
FIG. 1 shows a schematic diagram of a lightweight thin liner showing different components of the glove and reinforcement sections using plaiting.

Provided are gloves formed from lightweight yarns having areas of reinforcement at areas of high stretch and/or movement. Methods of making and using the same area also provided.

In certain applications, such as high duty industrial applications, lightweight gloves having a thin liner and a thin latex adherent coating are subjected to repeated stretches and movement. Specifically, highly stressed regions on the glove include base areas of the fingers and/or thumb portions, for example, where the fingers and/or thumb portions meet the palm portion of the glove. During use, spacings between the knitted yarns in the knitted liner are increased at these highly stressed regions. This stretch of the yarns is transferred to the thin adherent latex layer that is directly in contact with the liner and as a result, the thin adherent latex film may be weakened, and for example, separate into disconnected squares. Continued use of the lightweight glove results in wear and deterioration of the glove. Selective reinforcement to these highly stressed regions can be provided by three different approaches. These highly stressed regions are generally at the intersections of four fingers with the palm region and at the intersection of the thumb with the palm region.

With regard to the knitted liners, knitted liners can be made using V-bed (flat) knitting machines that use a number of needles in the form of a needle array and one or more yarn to knit the gloves using, for example, eight basic components to form the glove. These eight components include one component for each of the five fingers, two components for the palm including an upper section and a lower section; and one component for the wrist area. All these sections are cylinders or conical sections that join to each other fashioning the general anatomical shape of a hand. Conventional knitting processes use a knitting machine to knit each of these areas in a particular sequence, generally one finger at a time, beginning with the pinky finger and continuing on through the ring finger and middle finger to the forefinger. After each finger is knitted using only selected needles in the needle array, the knitting process for this finger is stopped and yarn is cut and bound. The knitted finger is held by holders, weighted down by sinkers. The next finger is knit sequentially one at a time using a different set of needles in the needle array. When all the four fingers are knitted in this fashion, the knitting machine picks up the stitches of previously knit four fingers that are held by the holders and then knits the upper section of the palm. The method of knitting individual fingers and picking stitches to knit the upper palm selection with better fitting crotches that are well fitted is discussed in U.S. Pat. No. 6,945,080 by Maeda, et al. After knitting an appropriate length of upper palm, the thumb portion is initiated using a separate set of needles in the needle array and the lower section of the palm is knit using all the needles in the needle array. Finally, the knitting machine knits the wrist component to the desired length.

The knitting stitches used at the fingertips can be generally tighter than the stitches used elsewhere in the glove to improve the strength of the glove in this area where more pressure is likely to be applied. Depending on the size of the needles used and the denier of the yarn to knit the gloves, a certain number of courses are used to create each of the eight components of the glove. The finer the gauge of needle used; the higher the number of courses for each component to create the same size of a finished glove. Changing needles or the denier of a yarn is extremely difficult in a continuous process and generally a continuous yarn of pre-selected denier and a corresponding needle size is commercially used. Thus, use of a V-bed knitting machine with an array of 18 gauge needles together with a 221 denier yarn allows creation of a thin lightweight liner, which has a high level of flexibility.

With regard to the latex coating, the flexibility of an elastic article is strongly determined by the geometry of the object. An elastic beam having a width 'B' with a thickness 'T' and a length 'L' subjected to a central load 'P' has a maximum deflection 'δ' at the load point given by the equation:

$$\delta - \frac{PL^4}{48EI}$$

where 'E' is the elastic modulus and I is the moment of inertia about the neutral axis given by the equation:

$$I = \frac{BT^3}{12}$$

where 'B' is the width of the beam and 'T' is the thickness of the beam. Similar relationship exists for other loading geometries of 'P'. In all cases, 'δ', the deflection is inversely proportional to the third power of the thickness 'T'. Therefore decreasing the thickness of the beam by 30 percent results in an increase in deflection or flexibility by a factor of 2.91 or nearly three.

Flexibility of gloves having an elastomeric coating, such as a glove latex coating, can be increased by decreasing the thickness of the glove. Since the glove has a knitted liner the flexibility may be enhanced by only partially penetrating the knitted liner thereby taking advantage of the knitted liner due to relative movement between the yarns of the knitted liner and the movement between the filaments of an individual yarn. This enhanced flexibility requires use of a thinner knitted liner and applying a thinner polymeric coating. Challenges are encountered in each of these approaches as discussed next.

Conventional knitting machines such as those supplied by Shima Seiki traditionally use a 15-gauge needle for knitting glove liners. This needle can accommodate a total yarn denier of 319 as indicated by p 209 of the book Knitting Technology by D. J. Spencer, published in 1993. A denier is the weight of the yarn in grams for a yarn length of 9000 meters. Considering nylon 66, which has a density of 1.13 g/cm$^3$, the volume of 319 grams is 282 cm$^3$. The average cross-sectional area of the 9000 meter yarn, in turn, is 0.031 mm$^2$, thereby resulting in a yarn having an average yarn diameter of 0.19 mm. This cross-section diameter calculation reflects the result for a single monofilament yarn, but a multifilament yarn of the same denier may have substantially larger cross-section diameter since voids are present between multiple filaments of the yarn. When these yarns are knitted to form a liner, at the crossing points, the cross-section diameter is nominally 0.38 mm. Since these yarns are normally produced by twisting multiple strands of finer filaments, the yarn diameter may be larger and correspondingly, the knitted liner may be thicker. In addition, the knitting process has a certain degree of slackness; the thickness of the knitted liner may be larger due to this slackness. For example, two ends of 2 ply/70 denier/34 filament with each filament having a denier of 2.08 has a total nominal denier of 280, which is suited for knitting with a 15-gauge needle to produce a prior art standard liner that is dipped with latex to produce a standard prior art glove. A liner prepared from such a yarn has a measured uncompressed thickness of 1.34 mm and a compressed thickness under 9 oz (225 grams) load of 1.13 mm using an Ames Logic basic thickness gauge model no. BG1110-1-04 according to ASTM D1777. The knitted liner is measured to have a basis weight of 167.9±5.3 grams/mm$^2$. When the knitted liner is coated with the polymeric latex emulsion, the yarns tend to come together providing a knitted liner thickness approximating the compressed thickness. The thickness of the polymeric latex coating approximates the thickness of the knitted liner. A 15-gauge knitted liner prepared from two ends of 2 ply/70 denier/34 filament coated with a polymeric latex coating results in a glove thickness of 1.15 mm to 1.5 mm such as Ansell 11-800. Ansell 11-600 glove which is a 15-gauge knitted glove is coated with solvent-based polyurethane with complete penetration and has a thickness nearly equal to that of the knitted liner which is approximately 1 mm. A Showa product BO-500 also uses a 15-gauge knitted liner which is completely penetrated by solvent-based polyurethane has a thickness nearly equal to that of the knitted liner which is approximately 1 mm.

Shima Seiki also has knitting machines that can use 18-gauge needles. Thus, smaller denier yarns may be used to produce knitted liners. According to p 209 of the book Knitting Technology by D. J. Spencer, published in 1993 the 18-gauge needle can use yarn with a total denier of 221. Considering the density of nylon 66 (1.13 g/cm$^3$), this yarn has a volume of 195 cm$^3$. The average cross-sectional area of the 9000 meter yarn, in turn, is 0.021 mm$^2$, thereby resulting in a yarn having an average yarn diameter of 0.16 mm. However, when a 140 denier yarn is used, the cross-sectional area is 0.014 mm$^2$ or an average yarn diameter is 0.13 mm. Thus, at yarn cross-over points, when using a 221 denier yarn, the knitted liner will have a minimum thickness of 0.32 mm. In practice this thickness is expected to be larger due to use of multiple filaments. In a specific example, a 70 denier yarn made-up of 103 filaments of 0.68 denier can be used. The knitted liner also has a certain degree of slackness. In addition to the use of 2 ends of a 1-ply 70 denier/103 filament yarn, the process may use a 2-ply/70 denier/103 filament yarn with a 140 denier or a 221 denier yarn to knit a liner. The use of a single 2-ply/70 denier/103 filament yarn wherein each filament has 0.68 denier resulted in a knitted liner, which is 0.83 mm in the uncompressed state and 0.67 mm in the compressed state under 9 oz (225 grams) load using Ames Basic Logic thickness gauge model no. BG1110-1-04 according to ASTM D1777. This knitted liner is measured to have a basis weight of 142.9±1.3 grams/m$^2$. When this 18-gauge needle knitted liner is coated with polymeric latex coating with a latex layer thickness close to the thickness of the knitted liner, the glove has a final thickness in the range of 0.6 mm to 1.14 mm. In a detailed embodiment, the glove has a thickness of from approximately 0.70 to approximately 0.90 mm. Since the yarn is made from very fine diameter partially oriented fibers, the flexibility of the yarn is very good. Thus the thickness of the glove is reduced by better than 30% providing better than 3 times improvement in the flexibility of the glove compared to a glove having a liner knitted from a 15-gauge needle. The overall weight of the latex glove is, likewise, lighter.

The gauge knitting needle used is generally selected according to the denier of the yarn being used. However, it is possible to use a larger gauge needle for a smaller denier yarn and this combination results in excessive spacing between the yarns in the knitted liner, which is larger than the desired one to three range. This is illustrated by the variations in the spacing between yarns in a knitted liner when 15-gauge and 18-gauge knitting needles are used. The interstices space is typically in the range of one to three times the diameter of the yarn used to knit the liner, when a proper needle gauge is selected. The 15-gauge needle can use a 280 denier yarn, having an average yarn diameter of 0.19 mm. The 18-gauge needle can use a 140 denier yarn, having an average yarn diameter of 0.13 mm. The relationship between the yarn diameter and the interstices changes when the liner is put on a former so that the interstices diameter can be three times larger than the yarn diameter.

Turning to the figures, FIG. 1 shows a schematic diagram of a lightweight thin liner showing different components of the glove and reinforcement sections using plaiting. In addition to the 221 denier yarn, a second yarn is introduced to provide an improved quantity of yarn in these highly stressed regions. When these regions are stretched, they do not separate the yarns very far and therefore, the adherent thin latex layer is preserved. FIG. 1 illustrates a glove 100, having eight glove components. These components include a pinky finger component 101, a ring finger component 102, a middle finger component 103, a forefinger component 104, an upper palm component 105, a lower palm component 107, a thumb component 106, and a wrist component 108. Reinforcement sections 111, 112, 113 and 114 are located at the bases of the pinky, ring, middle and forefinger components, respectively. An optional reinforcement section in the upper palm portion is shown at 115. Reinforcement sections 116, 117 and 118 are located at the base of the thumb component and across the lower palm component. Plaiting stitching is performed at 111, 112, 113, 114, 115, 116, 117 and 118 regions. Table 1 shows an exemplary course layout in each of the components and the yarn usage in each of the knitted courses. In one or more embodiments, the denier of yarn 1 is 70 to 221 and the denier of yarn 2 is less than 221, for example in the range of approximately 70 to approximately 221. This plaiting, which is the insertion of the second yarn, can be accomplished with a standard V-bed knitting machine.

TABLE 1

| Component | Section in FIG. 1 | Yarn 1 Courses | Yarn 2 Courses |
|---|---|---|---|
| 1 | 101 | 1-84 | — |
| | 111 | 85-88 | 85-88 |
| 2 | 102 | 1-112 | — |
| | 112 | 113-116 | 113-116 |
| 3 | 103 | 1-122 | — |
| | 113 | 123-126 | 123-126 |
| 4 | 104 | 1-112 | — |
| | 114 | 113-116 | 113-116 |
| 5 | 115 | 1-4 | 1-4 |
| | 105 | 5-28 | — |
| | 116 | 29-32 | 29-32 |
| 6 | 106 | 1-96 | — |
| | 117 | 97-100 | 97-100 |
| 7 | 118 | 1-4 | 1-4 |
| | 107 | 5-70 | — |
| 8 | 108 | 1-72 | — |

Figure 2:
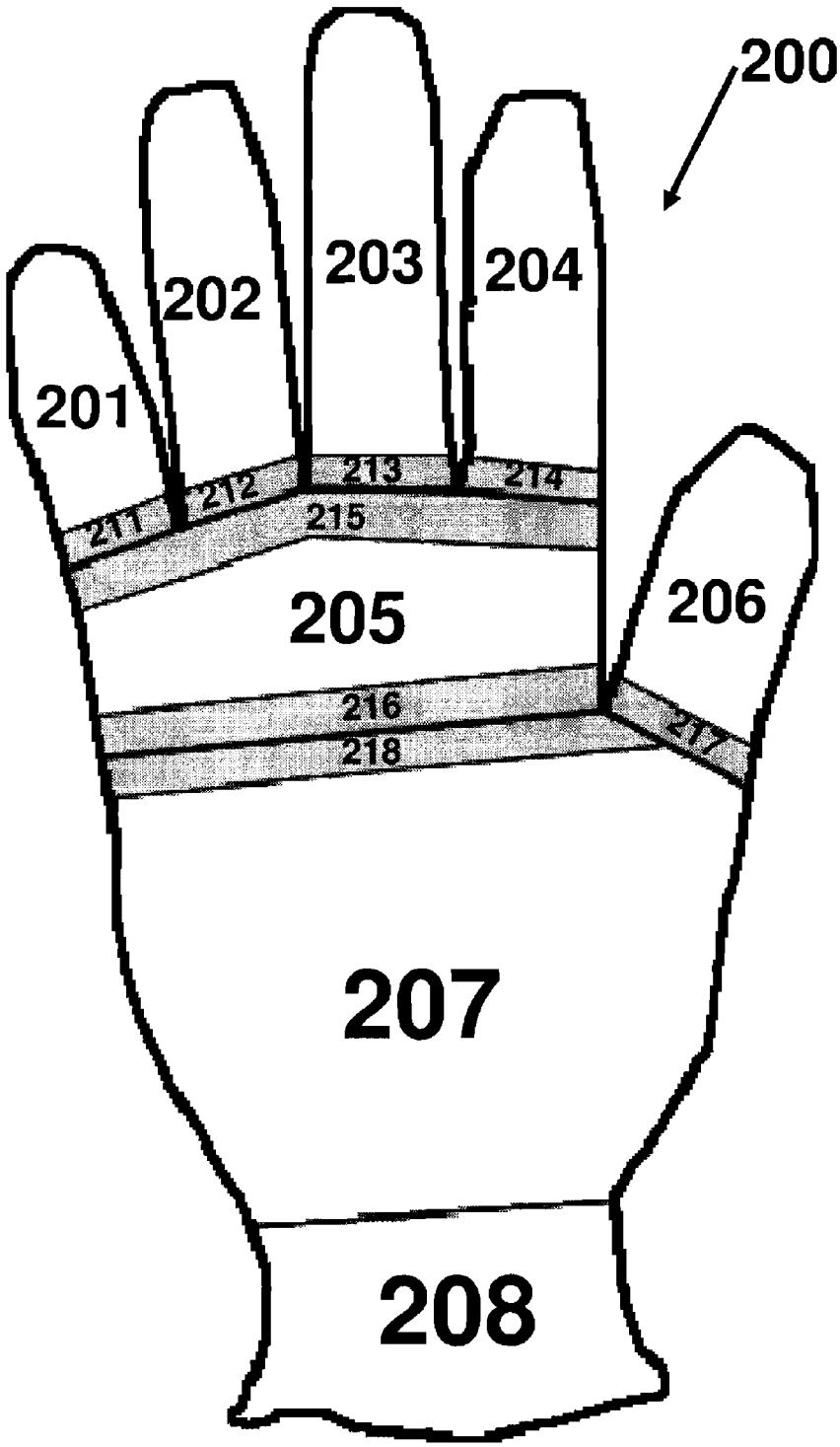
FIG. 2 shows a schematic diagram of a lightweight thin liner showing different components of the glove and reinforcement sections using yarn of a heavier denier than the rest of the glove.

FIG. 2 shows a schematic diagram of a lightweight thin liner showing different components of the glove and reinforcement sections using yarn of a heavier denier than the rest of the glove, thereby illustrating a second approach to providing reinforcement sections. FIG. 2 illustrates a glove 200 having eight major glove components. These components include a pinky finger component 201, a ring finger component 202, a middle finger component 203, a forefinger component 204, an upper palm component 205, a lower palm component 207, a thumb component 206, and a wrist component 208. Regions 211, 212, 213, 214, 215, 216, 217 and 218 are knitted with a yarn having a denier greater than 221, while the rest if the knitted liner is knitted with a 221 denier yarn. Table 2 shows an exemplary course layout in each of the components and the yarn usage in each of the knitted courses. In one or more embodiments, the denier of yarn 1 is 70 to 221 and the denier of yarn 2 is greater than 221. This change in yarn size can be accomplished with a standard V-bed knitting machine.

TABLE 2

| Component | Section in FIG. 2 | Yarn 1 Courses | Yarn 2 Courses |
|---|---|---|---|
| 1 | 201 | 1-84 | |
| | 211 | | 85-88 |
| 2 | 202 | 1-112 | |
| | 212 | | 113-116 |
| 3 | 203 | 1-122 | |
| | 213 | | 123-126 |
| 4 | 204 | 1-112 | |
| | 214 | | 113-116 |
| 5 | 215 | | 1-4 |
| | 205 | 5-28 | |
| | 216 | | 29-32 |
| 6 | 206 | 1-96 | |
| | 217 | | 97-100 |
| 7 | 218 | | 1-4 |
| | 207 | 5-70 | |
| 8 | 208 | 1-72 | |

Figure 3:
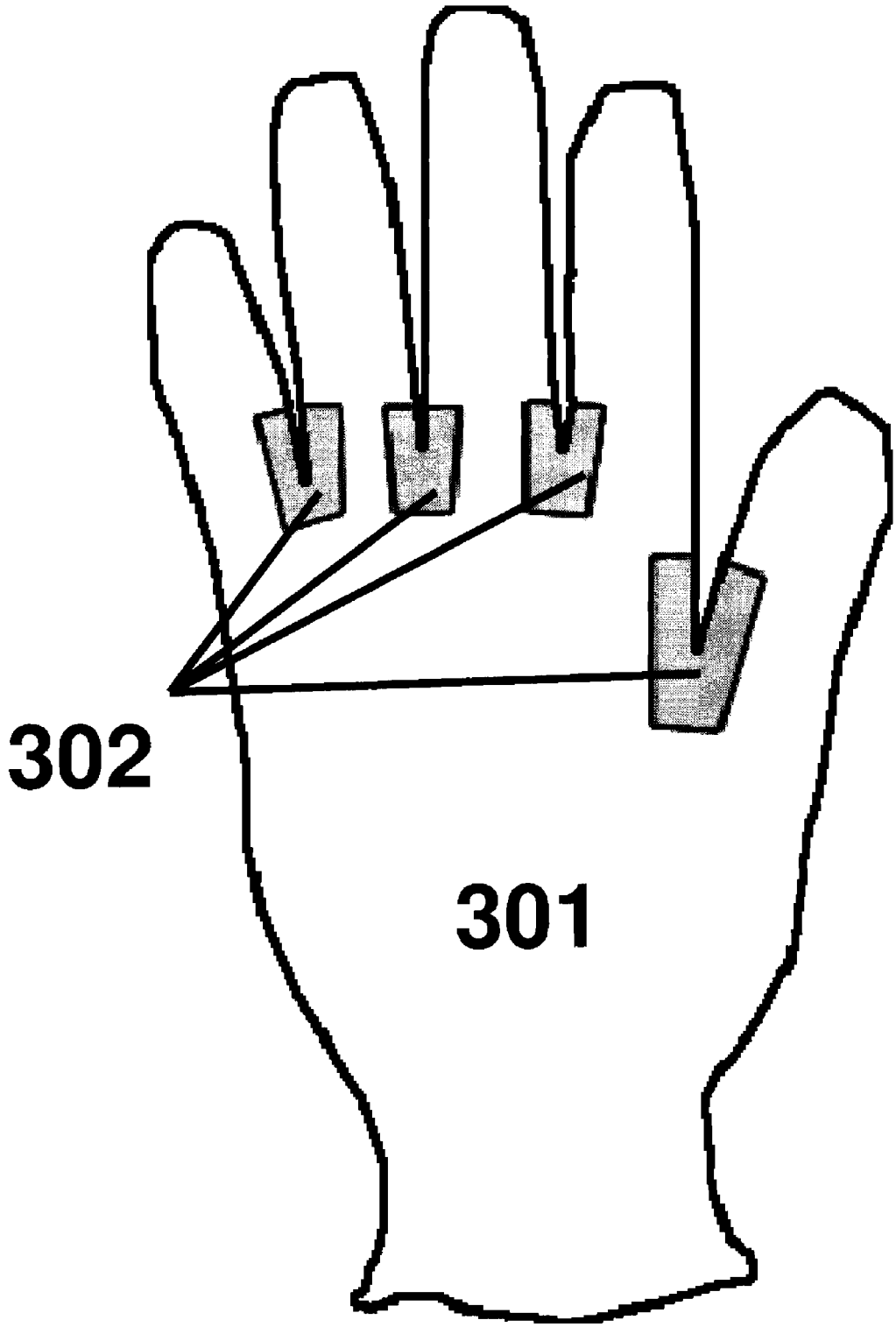
FIG. 3 shows a schematic diagram of a lightweight thin liner showing different components of the glove and reinforcement sections using Jacquard or transfer stitch.

FIG. 3 shows a schematic diagram of a lightweight thin liner showing different components of the glove and reinforcement sections using Jacquard or transfer stitch, thereby illustrating a third approach to providing reinforcement sections. Regions 302 are knitted with a 221 denier yarn using Jacquard knit stitch. This type of knitting requires yarn transfer capability and can be done by a so called 'whole garment' knitting machine. Shima Seiki markets the SWG021/041 and SWG-FIRST machines both of which use a two-component slider knitting needle providing the transfer capability. At the present time, the SWG021/041 machine is only available with 15 gauge needles. However, the SWG-FIRST uses gaugeless needle technology and the width of the course can be set on the fly under computer control. Not all knitting machines can provide a Jacquard stitch, however. It is generally understood that a standard V-bed knitting machine is not usually suitable for this. The region 301 which is the rest of the lightweight knitted liner is knitted with a 221 denier yarn using an 18-gauge needle. Table 3 shows the knitting layout in each of the two sections.

TABLE 3

| Section in FIG. 3 | Knit Structure |
|---|---|
| 301 | 18-gauge Jersey Knit |
| 302 | Jacquard Knit |

Technical problems exist when thin knitted liners are coated with aqueous polymeric latex. Difficulties with adhering the latex layer to the thin knitted liner and irritation to the skin of certain users upon contact with the latex layer have been recognized. As such, 18-gauge needle-knitted liners thus far have not been coated with aqueous polymeric latex emulsions. To address these technical problems, in accordance with aspects of the present invention, the reduced thickness of the knitted liner requires the polymeric latex emulsion to penetrate approximately half way or more to create adhesion between the polymeric latex coating and the knitted liner. For at least a portion of the knitted liner, the latex layer does not penetrate the entire thickness of the knitted liner, thereby substantially reducing contact between the polymeric latex and the user's skin when the glove is worn. In an embodiment, a skin-contacting surface of the knitted liner is substantially free of the polymeric latex coating. In a detailed embodiment, the skin-contacting surface of the knitted liner is approximately 75% or more free of the polymeric latex coating. The overall margin of error is significantly reduced with approaches according to aspects of the present invention.

Attempts to produce thinner gloves such as Ansell 11-600 or Showa BO-500, which use 15-gauge needle knitted liners and have thicknesses which are penetrated by solvent-based polyurethane, result in stiff gloves. The liners of these gloves become completely penetrated by the solvent-based polyurethane, thereby reinforcing the liner and increasing its elastic modulus 'E', and thereby decreasing the deflection. Also chemicals used in the solvent-based polyurethane do not readily wash off resulting in a stiffer glove. Despite this, in certain embodiments of the present invention, solvent-based polyurethanes are acceptable blocking agents and can be used along with the polymeric latex coatings which penetrate half way or more and for at least a portion of the knitted liner. The gloves of aspects of the present invention accomplish this glove geometry regardless of the yarn size using, for example, an 18-gauge needle.

Figure 4:
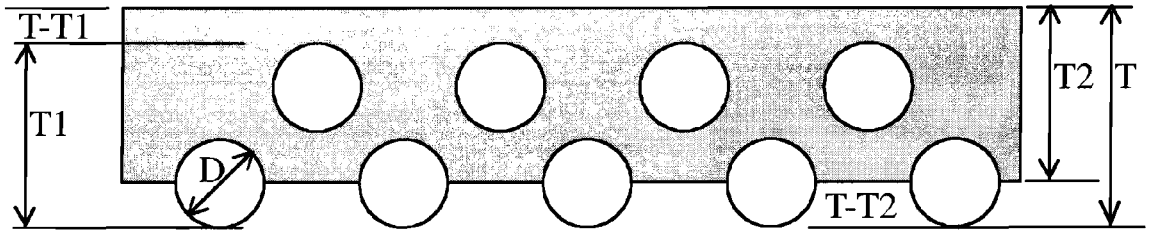
FIG. 4 shows a schematic diagram of a knitted liner with the polymeric latex layer penetrating halfway or more through the thickness of the knitted liner.

FIG. 4 illustrates schematically the arrangement of yarns in the knitted liner and its relationship to the polymeric latex coating, which may be foamed or unfoamed. The yarns having an average diameter D are knitted in the liner producing a liner with a thickness T1. The polymeric latex coating of thickness T2 penetrates the knitted liner producing an overall glove thickness. For at least a portion of the knitted liner, the distance defined by T-T2 is not penetrated by the polymeric latex coating and the degree of penetration is defined by the ratio (T−T2)/T1. If the coating penetrates the entire thickness of the liner, the unpenetrated region is zero regardless of the thickness T1 of the knitted liner. The polymeric latex coating that is present outside the liner is given by T−T1. Therefore, T2, the thickness of the polymeric latex coating, is generally in the range 0.75 to 1.25 of the thickness of the knitted liner T1. When the ratio is 0.75, the polymeric latex coating penetrates three quarters of the way into the liner when the top of the coating is flush with the fibers. The penetration may be smaller, but still greater than half way results in polymeric latex coating extending above the top of the fibers. At the ratio of 1.25, a polymeric latex coating penetrating three quarter way still has half the thickness of the polymeric latex coating outside the knitted liner. In this range, the geometry of FIG. 4 is accomplished with the polymeric latex coating covering the knitted liner, but not penetrating the entire thickness of the knitted liner.

A comparison is provided in Table 4 of typical properties as measured for an Ansell 11-800 glove with a 15-gauge knitted liner with a latex coating produced from an aqueous polymeric latex Ansell 11-600 with a 15-gauge knitted liner fully penetrated by solvent-based polyurethane coating, a Showa product BO-500 with a 15-gauge liner fully penetrated with solvent-based polyurethane. An exemplary glove according the present invention, referred to as Example I, was prepared using an 18-gauge knitted liner partially penetrated with carboxylated acrylonitrile-butadiene latex and is also shown in Table 4. These examples were chosen since they directly compare a 15-gauge needle conventional product with an 18-gauge product that is manufactured by methodology of the present invention. The Ansell 11-800 glove typically has a thickness of 1.15 to 1.5 mm while the thickness of a glove according to the present invention is 0.60 mm to 1.14 mm. In a detailed embodiment, the glove has a thickness of approximately 0.70 to approximately 0.90 mm. Accordingly the glove according to Example I is more flexible and provides better tactile sensitivity. The exemplary size 8 glove of Example I weighs 14.8 grams on average, while a similar size 8, 11-800 glove weighs 19.2 to 20.7 grams. Table 4 also shows the effectiveness of aqueous fluorochemical (FC) coating on the oil permeability on the product of Example I.

TABLE 4

| Product | Knitting Needle Gauge | Thickness mm | Palm wt oz/sq. yard | Clark Stiffness cm |
|---|---|---|---|---|
| Ansell 11-800 | 15 | 1.17 | 14 | 5.25 |
| Ansell 11-600 | 15 | 0.89 | 10 | 7.75 |
| BO-500 | 15 | 0.86 | 7 | NA |
| Example I | 18 | 0.84 | 10 | 4.2 |

A higher Clark stiffness number corresponds to a higher stiffness glove. The polyurethane coated Ansell 11-600 glove is rather stiff with a Clark stiffness of 7.75 cm in spite of its reduced thickness since polyurethane penetrates the entire thickness of the 15-gauge knitted liner reinforcing the liner creating a higher elastic modulus 'E', thereby decreasing deflection and flexibility. The 11-800 glove has a Clark stiffness of 5.25 cm, while the glove according to Example I has a Clark stiffness of 4.2 cm.

The manufacturing process for the lightweight thin flexible polymer coated glove involves several steps. In a detailed embodiment, an 18-gauge knitted liner with nominally 140 denier nylon 66 yarn is dressed on a hand shaped ceramic or metallic former and is immersed in a 2-15 wt % calcium nitrate aqueous solution. The calcium nitrate coagulant solution penetrates the entire thickness of the knitted liner. When this coagulant coated liner contacts aqueous polymeric latex emulsion, it destabilizes the emulsion and gels the latex. The coagulant coated knitted liner dressed on the former is next dipped in the aqueous polymeric latex emulsion. The polymeric aqueous latex has a viscosity in the range of 250-5000 centipoise and has commonly used stabilizers including but not limited to potassium hydroxide, ammonia, sulfonates and others. The latex may contain other commonly used ingredients such as surfactants, anti-microbial agents, fillers/additives and the like. Due to the smaller diameter of the yarn, the distance between the fibers decrease rapidly forming a pinch region in the knitted liner and when the polymeric latex emulsion enters this region, the gelling action essentially chokes the ingress of the polymeric latex emulsion, thereby substantially preventing the entire penetration of the polymeric latex emulsion into the thickness of the knitted liner. This penetration and gelling action is sensitive to the viscosity of the polymeric latex emulsion and the depth to which the former with the coagulant coated liner is depressed into the polymeric latex emulsion tank. The higher the hydrostatic pressure, the polymeric latex emulsion penetrates more into the knitted liner. When the immersion depth is small and the viscosity of the polymeric latex emulsion is high the polymeric latex coating minimally penetrates the knitted liner resulting in poor adhesion of the coating. Therefore two controllable process variables are available for precisely and reliably controlling the penetration of the polymeric latex coating into the knitted liner, even when the knitted liner is relatively thin. These process variables are 1) the control of polymeric latex emulsion viscosity and 2) depth of immersion of the knitted liner dressed former. Typical depth of immersion needed to achieve this aqueous polymeric latex emulsion to a depth greater than half the thickness of the knitted liner to a penetration that is less than the entire thickness is 0.2 to 5 cm, based on the viscosity of the latex emulsion. Since a latex coating of the glove is generally provided on the palm and finger areas of the glove, the former is articulated using a complex mechanism that moves the form in and out of the latex emulsion, immersing various portions of the knitted liner dressed on the former to progressively varying depths. As a result, some portions of the glove may have some degree of latex penetration, however, more than 75% of the knitted liner is penetrated at least half way or more than halfway without showing latex stain on the skin-contacting surface of the glove. The first embodiment of the process produces a thin continuous latex gelled layer on a thin knitted liner is washed first and is subsequently heated to vulcanize the latex composition and is washed to remove coagulant salts and other processing chemicals used to stabilize and control viscosity and wetting characteristics of the latex emulsion. The glove thus produced is better than 30% less in weight and thickness compared to a 15-gauge glove, and has better than three times the flexibility.

In a second embodiment of the invention, the polymeric latex emulsion used is foamed. The air content is typically in the 5 to 50% range on a volume basis. The polymeric latex emulsion may contain additional surfactants such as TWEEN 20 to stabilize the latex foam. Once the latex is foamed with the right air content and the viscosity is adjusted, refinement of the foam is undertaken by using the right whipping impeller stirrer driven at an optimal speed first and the air bubble size is refined using a different impeller run at a reduced speed. This foamed polymeric latex emulsion generally has a higher viscosity and therefore is more difficult to penetrate the interstices between the yarns in the knitted liner and may require a higher depth of immersion of the former with dressed knitted liner. The penetrated foamed latex emulsion instantly gels due to the action of the coagulant resident of the surfaces of the yarns forming chocking regions between the fibers preventing further entry of the foamed latex emulsion into the thickness of the knitted liner. The air cells reduce the modulus of elasticity of the polymeric latex coating increasing the flexibility of the glove. The air content in the range of 5-15 volumetric percentile results in foams that have closed cells and the polymeric latex coating is liquid impervious. This coating has a spongy soft feel. Some of the air cells adjacent to the external surface open out providing increased roughness and have the ability to remove boundary layer of oil and water from a gripping surface, providing increased grip. When the volumetric air content is in the range of 15-50%, the air cells are adjacent to each other and during vulcanization heating step, they expand, touch each other creating an open celled foam. The polymeric latex coating of the glove is breathable and the glove does not become clammy.

Having thus described various aspects of the invention in rather full detail, it will be understood that such detail need not be strictly adhered to, but that additional changes and modifications may suggest themselves to one skilled in the art, all falling within the scope of the invention as defined by the claims.

What is claimed is:

1. A glove, comprising:

a knitted liner having a thickness of about 0.70 mm to about 0.90 mm and a plurality of stitches made from a first yarn having a denier 221 or less, the knitted liner comprising a plurality of finger components, a thumb component, and a palm component;

at least one reinforcement section located at a base of at least one finger component, at a base of the thumb component, in the palm component, or combinations thereof; and a polymeric latex coating adhered to the knitted liner, the polymeric latex coating penetrating half way or more for at least a portion of the knitted liner, the coating not penetrating the entire thickness of the knitted liner.

2. The glove of claim 1, wherein the polymeric latex coating penetrates half way or more through a thickness of the knitted liner, and for at least a portion of the knitted liner, the polymeric latex coating does not penetrate the entire thickness of the knitted liner; and the polymeric latex coating has a thickness in a range of 0.75 to 1.25 times the thickness of the knitted liner.

3. The glove of claim 1 wherein the first yarn has a denier in the range of approximately 70 to approximately 221.

4. The glove of claim 1, wherein the at least one reinforcement section is located along the bases of the plurality of finger components.

5. The glove of claim 1, wherein the at least one reinforcement section comprises a plurality of plaited stitches comprising the first yarn and a second yarn having a denier in the range of approximately 70 to approximately 221.

6. The glove of claim 1, wherein the plurality of stitches made from a first yarn having a denier 221 or less are located in the knitted liner in an area other than the reinforcement section and the at least one reinforcement section comprises a second yarn having a denier greater than 221.

7. The glove of claim 1, wherein the at least one reinforcement section comprises a plurality of Jacquard or transfer stitches.

8. The glove of claim 1, wherein the polymeric latex coating is selected from the group consisting of natural rubber, synthetic polyisoprene, styrene-butadiene, carboxylated or non-carboxylated acrylonitrile-butadiene, polychloroprene, polyacrylic, butyl rubber, a waterbased polyester-based polyurethane, a water-based polyether-based polyurethane, or combinations thereof.

9. The glove of claim 1, wherein the polymeric latex coating comprises carboxylated acrylonitrile-butadiene.

10. The glove of claim 1, wherein the first yarn comprises nylon 66.

11. A process for making a lightweight flexible glove, the process comprising:

creating a glove-shaped liner comprising a plurality of finger components, a thumb component, and a palm component, such that the liner has a thickness of about 0.70 mm to about 0.90 mm and comprises a plurality of stitches made from a first yarn having a denier of approximately 221 or less;

creating at least one reinforcement section located at a base of at least one finger component, at a base of the thumb component, in the palm component, or combinations thereof; and providing a polymeric latex coating adhered to the knitted liner, the polymeric latex coating penetrating half way or more for at least a portion of the knitted liner, the coating not penetrating the entire thickness of the knitted liner.

12. The process of claim 11 comprising locating the at least one reinforcement section along the bases of the plurality of finger components.

13. The process of claim 11, wherein the step of creating the plurality of stitches made from the first yarn comprises using a knitting machine with an 18-gauge needle.

14. The process of claim 11 further comprising using a knitting machine, wherein the liner is created entirely from the first yarn and the at least one reinforcement section is created from a plurality of plaited stitches comprising the first yarn and a second yarn having a denier in the range of approximately 70 to approximately 221.

15. The process of claim 11 further comprising using a knitting machine, wherein the plurality of stitches made from the first yarn are located in the liner in an area other than the at least one reinforcement section and the at least one reinforcement section is created from a second yarn having a denier greater than 221.

16. The process of claim 11 further comprising using a knitting machine to create the liner entirely from the first yarn and create the at least one reinforcement section from a plurality of Jacquard or transfer stitches.

17. The process of claim 16, wherein the knitting machine is a whole garment knitting machine.

18. The process of claim 17, wherein the knitting machine is gaugeless.

19. A method of performing industrial work, the method comprising wearing a glove, comprising: a knitted liner having a plurality of stitches made from a first yarn having a denier 221 or less, the knitted liner having a thickness of about 0.70 mm to about 0.9 mm, the knitted liner comprising a plurality of finger components, a thumb component, and a palm component; at least one reinforcement section located at a base of at least one finger component, at a base of the thumb component, in the palm component, or combinations thereof; and a polymeric latex coating adhered to the knitted liner, the polymeric latex coating penetrating half way or more for at least a portion of the knitted liner, the coating not penetrating the entire thickness of the knitted liner.

20. A glove, comprising:

a knitted liner having a plurality of stitches made from a first yarn having a denier in the range of 70 to 221, the knitted liner having a thickness of about 0.70 mm to about 0.90 mm, the knitted liner comprising a plurality of skin-contacting finger components, a skin-contacting thumb component, and a palm component;

at least one reinforcement section located at a base of at least one finger component, at a base of the thumb component, in the palm component, or combinations thereof; wherein the at least one reinforcement section comprises a plurality of plaited stitches comprising the first yarn and a second yarn having a denier in the range of 70 to 221 such that the denier of the second yarn is the same or less than the denier of the first yarn; and a polymeric latex coating adhered to the knitted liner, the polymeric latex coating penetrating half way or more for at least a portion of the knitted liner, the coating not penetrating the entire thickness of the knitted liner.

* * * * *